US011771249B2

(12) United States Patent
Rees

(10) Patent No.: US 11,771,249 B2
(45) Date of Patent: Oct. 3, 2023

(54) FLEXIBLE STRAW WITH CONTROL MEANS FOR USE WITH A DRINKING VESSEL

(71) Applicant: AR Design Consulting Limited, Newcastle upon Tyne (GB)

(72) Inventor: Arnold Rees, Newcastle upon Tyne (GB)

(73) Assignee: AR Design Consulting Limited, Newcastle upon Tyne (GB)

( * ) Notice: Subject to any disclaimer, the term of this patent is extended or adjusted under 35 U.S.C. 154(b) by 36 days.

(21) Appl. No.: 16/765,827

(22) PCT Filed: Nov. 23, 2018

(86) PCT No.: PCT/GB2018/053393
§ 371 (c)(1),
(2) Date: May 20, 2020

(87) PCT Pub. No.: WO2019/102209
PCT Pub. Date: May 31, 2019

(65) Prior Publication Data

US 2020/0352368 A1 Nov. 12, 2020

(30) Foreign Application Priority Data

Nov. 26, 2017 (GB) ..... 1719611.4

(51) Int. Cl.
*A47G 19/22* (2006.01)
*B65D 47/06* (2006.01)
(Continued)

(52) U.S. Cl.
CPC ..... *A47G 19/2266* (2013.01); *A47G 21/189* (2013.01); *B65D 47/06* (2013.01);
(Continued)

(58) Field of Classification Search
CPC ..... A47G 19/2272; A47G 21/18; A47G 19/2266; A47G 2400/027;
(Continued)

(56) References Cited

U.S. PATENT DOCUMENTS 10,433,665 B2 * 10/2019 Zhang ..... B65D 47/32
10,835,065 B2 * 11/2020 Lohn ..... A47G 21/185
(Continued)

FOREIGN PATENT DOCUMENTS

CN 106913159 A 7/2017
EP 1199014 A2 4/2002
(Continued)

OTHER PUBLICATIONS

Merriam-Webster, Slit—definition, 2023, Merriam-Webster, www.merriem-webster.com (Year: 2023).*
(Continued)

*Primary Examiner* — Jennifer Robertson
*Assistant Examiner* — John Martin Hoppmann
(74) *Attorney, Agent, or Firm* — BURR & FORMAN LLP

(57) ABSTRACT

A non-spill drinking cup system includes a container; a lid assembly that is removably attachable to the container, comprising an aperture; and a drinking tube, wherein the drinking tube extends through the aperture, the drinking tube including an open end, a closed end, and a side wall; and a drinking valve, wherein the drinking valve includes at least one elongate slit disposed within the side wall.

23 Claims, 19 Drawing Sheets

(51) Int. Cl.
*B65D 47/32* (2006.01)
*B65D 51/16* (2006.01)
*A47G 21/18* (2006.01)

(52) U.S. Cl.
CPC ..... *B65D 47/32* (2013.01); *B65D 51/16* (2013.01); *B65D 2205/02* (2013.01); *B65D 2543/00046* (2013.01); *B65D 2547/063* (2013.01)

(58) Field of Classification Search
CPC ..... B65D 2543/00046; B65D 47/32; B65D 2205/02; B65D 47/066; B65D 47/0857; B65D 47/248; B65D 51/165; B65D 2547/066; B65D 47/065; B65D 47/20; B65D 47/2031; B65D 51/16; A61J 9/006; A61J 9/085
USPC ..... 220/705, 714, 203; 215/11.5, 388, 307; 222/490; 135/455
See application file for complete search history.

(56) References Cited

U.S. PATENT DOCUMENTS

| | | | | |
|---|---|---|---|---|
| 2009/0014403 | A1 | 1/2009 | Lu | |
| 2011/0049169 | A1 | 3/2011 | Rosnak et al. | |
| 2011/0079601 | A1 | 4/2011 | Steininger | |
| 2014/0163463 | A1* | 6/2014 | Agbo | A61J 7/0046 604/78 |
| 2016/0120343 | A1* | 5/2016 | Liang | A47G 19/2266 220/303 |
| 2016/0235229 | A1* | 8/2016 | Lohn | F16K 15/147 |
| 2017/0007050 | A1* | 1/2017 | Parker | B65D 47/24 |
| 2017/0190481 | A1* | 7/2017 | Leimone | B65D 47/066 |
| 2017/0354279 | A1 | 12/2017 | Lohn et al. | |

FOREIGN PATENT DOCUMENTS

| | | | | |
|---|---|---|---|---|
| EP | 3214013 | A1 | 9/2017 | |
| GB | 2488118 | A * | 8/2012 | A47G 19/2266 |
| JP | 2019190599 | A * | 10/2019 | |
| WO | WO-2008131437 | A1 | 10/2008 | |
| WO | WO-2016102698 | A1 | 6/2016 | |

OTHER PUBLICATIONS

Vistisen, Lars; International Search Report; PCT/GB2018/053393; dated Feb. 15, 2019; 4 pages.

* cited by examiner

SECTION A-A

SECTION B-B

FLEXIBLE STRAW WITH CONTROL MEANS FOR USE WITH A DRINKING VESSEL

This invention relates to improvements to a non-spill drinking cup valve system. In particular, the non-spill drinking cup valve system includes a container, a lid assembly and a drinking tube. The drinking tube extends through an aperture located in the lid assembly and also includes an open end, a closed end, and a side wall. A drinking valve is provided as an elongate slit disposed within the side wall of the drinking tube.

More generally, this invention comprises a unitary flexible straw and valve component, designed for ease of drinking by enabling full flow through the valve and flexible straw, whilst maintaining a liquid seal when not in use, thereby preventing accidental spills.

INTRODUCTION

Tubular drinking straws used in drinking cups are well known and come in a variety of designs, constructions and materials. They may be simple and inexpensive to manufacture, and include rigid and semi-rigid tubular straws. However, rigid straws tend to be too rigid to bend effectively and so tend to be unsuitable for the user. Those of more flexible construction allow the straw to be bent, or flexed laterally or axially, through the use of a flexible corrugated area or from the use of flexible materials such as silicone. Currently, semi-rigid, or flexible, straws are preferred.

Such semi-rigid straws typically used in infant drinking cups may also incorporate valve arrangements to control liquid flow and prevent spillage.

A number of drinking cup systems incorporating flexible non-spill straws fitted with valve devices are well known in the art. They largely fall into two categories: those which have separate valve means inside the drinking cup or vessel which require some valve pre-assembly to provide suitable valve means; and those which form a flow regulating valve through a thin membrane, often using a slit type valve, to provide the non-spill function.

A major disadvantage of such valves in the art is that, due to the complex construction, they are often difficult to assemble and disassemble for regular cleaning, and thereby can suffer damage. As the valve can be damaged during the assembly or disassembly process, the non-spill and hygienic properties of the valve cannot be ensured. Valves known in the art are also more costly to manufacture due to their complex construction.

Another disadvantage of current flexible straws with integrated valves is that the cross-sectional dimensions of the straw valve designs used can be quite small as the valves are often incorporated within the through bore of the straw itself. This kind of design typically uses very thin flexible membranes which, when slit-type valves are used, renders the valve prone to damage and tearing at the valve slit, which in turn impacts on the non-spill characteristics of the drinking cup valve system, preventing it from being used as effectively as intended.

A further disadvantage associated with valve designs commonly used in straws is that, being typically quite small, they can also restrict the liquid flow rate. These smaller valves often require higher suction forces since the user must not only overcome the valve opening negative pressure required for drinking, but also the need to overcome negative pressure required to draw the fluid up the straw itself when drinking.

The invention aims to obviate or mitigate one or more disadvantages associated with current non-spill drinking cup valve systems utilising a flexible straw with an integral valve.

In particular, it is an objective of the present invention to provide a non-spill drinking cup valve system that includes an integrated straw and valve component. It is also an objective to provide a non-spill drinking cup valve system that includes an integral valve that opens wide enough to allow a greater liquid flow rate through the valve of the system.

Moreover, it would be beneficial to provide a non-spill drinking cup valve system that allows the user to drink fluid easily from the container through suction of a straw; that is securely attached to the lid of the drinking vessel; and that cannot be accidentally dislodged; and also provides a secure seal that enables liquid to be transported without spillage.

The non-spill drinking cup valve system should also be easy to remove for cleaning purposes, without inflicting damage to the valve system. It is also an objective of the present invention to provide a non-spill drinking cup valve system that is constructed from fewer parts and therefore less costly to manufacture.

SUMMARY OF INVENTION

In one aspect, there is provided a non-spill drinking cup system comprising a container; a lid assembly that is removably attachable to the container, comprising an aperture; and a drinking tube, wherein the drinking tube extends through the aperture, the drinking tube comprising: an open end, a closed end, and a side wall; and a drinking valve, wherein the drinking valve includes at least one elongate slit disposed within the side wall.

That is to say, there is provided a non-spill drinking cup system, including a container, cup or vessel; a lid or a lid assembly that is attachable to the container, cup or vessel in a manner which may be easily removable, or removably attachable; and a drinking tube.

The drinking tube may be cylindrical, or may be any other appropriate shape, cross-section or dimension for functioning as described. Generally, the drinking tube extends through an aperture provided within the lid assembly, and includes an open end, a closed end and a side wall. The open end may be provided at a first end and the closed end may be provided at the second, opposing, end. The side wall may be cylindrical or any other suitable shape or cross-section.

A drinking valve includes, or is provided in the form of, at least one elongate slit. The drinking valve may include exactly one elongate slit. The drinking valve may include more than one elongate slit. That is, the drinking valve may include a plurality of elongate slits. The or each elongate slit is a slit having a length, disposed within the side wall.

Where more than one elongate slit is included within the side wall, the plurality of elongate slits may be parallel. That is, two or each of the plurality of elongate slits may be parallel.

Optionally, the plurality of elongate slits may be aligned, that is, they may both be included on the same axis. That is, two or each of the plurality of elongate slits may be aligned on a single axis.

It may be preferable that a single elongate slit is included in the side wall. That is, it may be preferable for the drinking valve to include exactly one, or a single, elongate slit.

In the general and detailed description below, references to an elongate slit or the elongate slit includes references to a plurality of elongate slits or the plurality of elongate slits respectively, and vice versa.

In use, the user provides suction (i.e. drinks) at the open end of the drinking tube, which in turn opens the elongate slit located within the side wall. Fluid is then allowed to flow through a gap created by the elongate slit, into the drinking tube, through the drinking tube, and out of the open end into the user's mouth. Conversely, when suction is no longer provided at the open end of the drinking tube, the elongate slit (i.e. the drinking valve) closes, thereby providing a liquid seal and stopping fluid from flowing into the drinking tube.

This provides the advantage that the drinking valve is able to open easily and provide the user with more control when drinking owing to the elongate slit in the side wall. Moreover, the drinking tube is provided as a single piece, which allows for ease of removal and cleaning.

Preferably, the drinking tube has a longitudinal axis, and the slit is substantially parallel with the longitudinal axis. That is, the slit may be an elongate slit, which may be substantially vertical. That is, the slit may be parallel with a longitudinal axis of the drinking tube.

Optionally, the drinking tube may further include a drinking straw portion at the open end of the drinking tube; a drinking valve portion, including the drinking valve, at the closed end of the drinking tube; and an intervening portion between the drinking straw portion and the drinking valve portion.

That is, the drinking tube may be formed of three distinct portions: a first portion at the open end that forms a drinking straw portion where the user may drink fluid from the non-spill drinking cup system; a second portion at the closed end that forms a drinking valve portion where the valving means is provided for controlling fluid flow; and a third portion, separating the first and second portions, that is provided as an intervening, or otherwise separating, portion.

That is, the drinking tube may include an integral drinking straw portion, intervening portion and drinking valve portion. That is, the drinking tube may be a single piece that includes the three distinct portions of a drinking straw portion; a drinking valve portion; and an intervening portion therebetween.

This provides the advantage that additional components to secure the drinking tube to the lid assembly are negated. The intervening portion provides an area in which other features may be located integrally, without compromising the valving mechanism or liquid seal, and without requiring additional components to secure the parts in place.

Optionally, the intervening portion may be annular, and the annular intervening portion may be concentric with the drinking valve portion.

That is, the intervening portion may generally be annular, that is circular having an aperture therein. The annular intervening portion may surround part of, substantially most of, or all of the drinking valve portion. That is, the annular intervening portion may extend, concentrically, towards the closed end of the drinking tube.

This provides the advantage that the intervening portion may engage with a corresponding boss of the lid assembly in use.

Optionally, a thickness of a wall of the intervening portion may be greater than a thickness of a wall of the drinking valve portion.

That is, the wall of the drinking valve portion may have a first thickness and the wall of the intervening portion may have a second thickness. The first thickness may be less than the second thickness. That is to say, the drinking valve portion has a wall thickness that is less than the wall thickness of the intervening portion.

This provides the advantage that the intervening portion provides protection for the drinking valve portion, thereby mitigating the risks associated with damaging the valving mechanism. Specifically, when the intervening portion is annular, a circumferential protective portion is provided about the drinking valve.

Optionally, the intervening portion may be adapted to secure the drinking tube to the lid assembly.

That is to say, the intervening portion may be configured, constructed or designed such that the drinking tube may be secured to the lid assembly in use. Preferably, such a securing mechanism is a releasably attachable mechanism, for example, a frictional engagement.

This provides the advantage that the drinking tube may be releasably attached to the lid assembly, or otherwise secured, without the need for additional components.

Optionally, the non-spill drinking cup system may further include an extension straw that frictionally engages with the intervening portion such that the drinking valve portion extends into the through bore of the extension straw.

That is, the intervening portion may frictionally engage an extension straw to secure the extension straw to the drinking tube. The extension straw may be rigid or semi-rigid and serve to allow the user to drink fluid from the bottom of the container. The frictional engagement may provide a liquid seal at the point of contact between the extension straw and the intervening portion.

Preferably, when the extension straw is frictionally engaged to the intervening portion, the drinking valve extends into, and is contained within, the extension straw. That is, in use, the drinking valve is located within the extension straw, and the extension straw frictionally engages the intervening portion to secure the components together.

In use, the user provides suction (i.e. drinks) at the open end of the drinking tube, which in turn opens the elongate slit located within the side wall. Fluid is then allowed to flow up the extension straw, through a gap created by the elongate slit, into the drinking tube, through the drinking tube, and out of the open end into the user's mouth. Conversely, when suction is no longer provided at the open end of the drinking tube, the elongate slit, i.e. the drinking valve, closes, thereby providing a liquid seal and stopping fluid from flowing into the drinking tube.

This provides the advantage that the user can drink fluid from the bottom of the container, and also that the components can be readily disassembled for cleaning and the like.

Optionally, the closed end may be convex.

That is, the closed end of the drinking tube may be convex in shape.

This provides the advantage that the properties of the elongate slit drinking valve are altered such that the user is provided with more control over the fluid flow, since the elongate slit will open under a reduced applied suction.

Optionally, the or each elongate slit may be 5-10 mm in length.

That is, the or each elongate slit may have a length of approximately 5 mm to approximately 10 mm. In some embodiments, the or each elongate slit may have a length of 5 mm, or of 10 mm. That is, each one of the elongate slits may have a length of approximately 5 mm to approximately 10 mm, where a plurality of elongate slits is included.

Alternatively, there may be a single elongate slit that may have a length of approximately 5 mm to approximately 10 mm.

This provides the advantage that the elongate slit fully opens when suction is applied such that a full fluid flow rate is achieved.

Optionally, a thickness of the side wall may vary from one side to another side.

That is, the thickness of the side wall may vary from a first side to a second side. The first and second sides may be adjacent or opposite. The side wall may take any suitable shape, and the thickness may vary between each and/or every side.

Preferably, the thickness of the side wall may vary about its circumference.

That is, over the circumference of the side wall of the drinking tube, the thickness of said side wall may vary. That is, the thickness in the side wall may be different at a first point when compared to a second point at any other point of the circumference.

Optionally, an interior of the side wall may be provided with at least one pair of strengthening ribs, each strengthening rib may be disposed substantially near to, and at each side of, the or each elongate slit.

That is to say, where a single elongate slit is included, there may be provided a pair of strengthening ribs. Each rib of the pair of ribs may located at each side of the elongate slit, at the interior of the side wall. Each rib may be located substantially near to the elongate slit.

That is, where a plurality of elongate slits are included in the drinking valve, there may be provided at least one pair of strengthening ribs. That is, only one of the plurality of elongate slits may include a pair of ribs. Moreover, more than one of the plurality of elongate slits, or all of the plurality of elongate slits, may include a pair of ribs.

Preferably, the pair of strengthening ribs may be a pair of elongate strengthening ribs. The elongate strengthening ribs may be parallel with a central axis of the drinking tube and/or the elongate slit.

This provides the advantage that the drinking valve is prevented from collapsing when suction is applied. Instead, the elongate slit opens interiorly, that is inwardly towards the central axis of the drinking tube, about the longitudinal ribs, which may form a pivot point for the elongate slit. In this way, the elongate slit can open and close readily without the drinking valve collapsing under suction.

Optionally, the strengthening ribs separate the side wall into a first side and a second side. The first side may have a thickness that is greater than the second side, and the or each elongate slit may be included within the second side.

That is to say, the side wall may be arranged in at least two sides: a first side and a second side. The second side is delineated, or separated, from the first side by the strengthening ribs. The second side of the side wall may have a thickness that is less than the first side of the side wall. Conversely, the first side of the side wall may have a thickness that is greater than the second side of the side wall.

The first and second sides may also be regarded as first and second sections, first and second segments, first and second portions, or the like.

This provides the advantage that the elongate slit can open under reduced suction levels, such that better control is provided to the user. Moreover, the thinner walled second side, in which the elongate slit is located, is more inclined to collapse, or in use open, rather than the thicker walled first side collapsing. This mitigates the problems associated with such drinking valves collapsing completely under suction.

Optionally, the side wall may have a first thickness at a first point in which the or each elongate slit is located, and a second thickness at a second point, the second point being on an opposite side of the first point, wherein the thickness at the second point may be greater than the thickness at the first point.

That is to say, a point opposite from the point at which the elongate slit is located within the side wall may have a thickness that is greater. That is to say, the thickness of the side wall immediately adjacent to the elongate slit is thinner than the point of the side wall opposite.

Preferably, the first point and the second point may be diametrically opposite.

That is, the first point and the second point may oppose one another across a diameter.

This provides the advantage that the elongate slit can open under reduced suction levels, such that better control is provided to the user. Moreover, the thinner walled second portion, in which the elongate slit is located, is more inclined to collapse, or open, in use, rather than the thicker walled first portion collapsing. This mitigates the problems associated with such drinking valves collapsing completely under suction.

Optionally, the thickness of the side wall increases gradually from the first point to the second point.

That is, there may be a gradual increase in thickness from the first point to the second point.

This provides the advantage that the collapsing of the valve is isolated to the elongate slit, which then can open under reduced suction, thereby providing more control to the user as they drink.

Optionally, the drinking straw portion may include a flange, wherein the flange may include a chamfered upper edge and a squared-off lower edge.

That is to say, the flange may include an upper, or first, edge and a lower, or second, edge. The upper edge may be chamfered, or otherwise angled to form an angled face. The lower edge may be squared-off.

This provides the advantage that the drinking tube is prevented from being pushed readily, by an infant, through the aperture and into the container. Moreover, the chamfered edge allows the user to easily insert the drinking tube through the aperture during assembly.

Optionally, the drinking tube may further include a venting valve.

This provides the advantage that the internal pressure of the container may be equalised with respect to the external pressure of the container. In this way, the user may continue to drink from the system with ease.

Optionally, the venting valve may include a venting valve slit.

Optionally, the venting valve may include a concave portion comprising the venting valve slit.

That is to say, the venting valve may have a portion that is concave in shape, with the venting valve slit located within the concave section. That is, the venting valve slit may also be concave in shape.

This provides the advantage that the venting valve can be more readily opened when pressure builds up within the container.

Optionally, the venting valve may include a lip which engages with the lid assembly to provide a liquid seal to prevent fluid flowing through a venting hole.

That is to say, the lip may form a liquid or fluid seal with the lid assembly in use, thereby preventing fluid from flowing through a venting hole. When suction is applied and pressure builds up, this lip may be caused to disengage from the lid assembly, thereby allowing the internal pressure to equalise with the external pressure.

Optionally, the venting valve may engage with a venting boss provided on the lid assembly.

That is to say, the venting valve, or a portion thereof, may engage to form a liquid seal at a boss located on the lid assembly.

This provides the advantage that, during assembly, the venting valve can be correctly located within the lid assembly.

Optionally, the intervening portion may include a removal tab.

That is, the intervening portion may include a tab, a handle or otherwise a means for aiding the user to grasp the intervening portion, thereby enabling removal.

This provides the advantage that the user may easily disassemble the system for cleaning or the like.

Optionally, the lid assembly may comprise a drinking straw locating boss having the aperture therein.

That is to say, the lid assembly may include a locating boss for the drinking tube which surrounds, preferably concentrically, the aperture through which the drinking tube is received.

This provides the advantage that the user can easily locate the drinking tube within the lid assembly.

Optionally, the lid assembly includes a circumferential shoulder that is configured to frictionally engage with a squared lower edge of a flange of the drinking tube.

This provides the advantage that the user is prevented form pushing the drinking tube back through the aperture and into the container with ease.

Optionally, the drinking tube may comprise of silicone or a thermoplastic elastomer.

That is, the drinking tube may be constructed from silicone or a thermoplastic elastomer.

Optionally, the drinking tube may have a Shore A hardness of 20-60.

Optionally, the lid assembly may include a sliding cover, and the drinking tube may be adjustable from a drinking position, where the drinking tube protrudes from the aperture of the lid assembly, to a closed position, where the drinking tube is held within a slot of the lid assembly by the sliding cover.

This provides the advantage that the drinking tube may be stored away when not in use, thereby preventing damage to the drinking tube.

Optionally, the lid assembly and the container may be secured by a screw thread, a push-fit or a clip-fit.

In another aspect, there is provided a drinking tube as described herein for inserting through a lid assembly of a non-spill drinking cup system.

In other aspects, a non-spill drinking tube assembly with integral valve system is provided, which opens under low suction and delivers full flow through the drinking tube such that the user may drink easily and also transport the said container of liquid without spillage.

In other aspects, there is provided a non-spill drinking tube with integral valve system comprising a lid assembly, an upper flexible unitary drinking straw portion and valve component removably fitted to the lid, and a lower semi-rigid extension straw for use with any drinking vessel base.

In another aspect, the system comprises of a unitary drinking tube component. It is an object of the present invention to provide a flexible, unitary, drinking tube construction for a drinking vessel, in which an upper proximal straw portion is removably and frictionally connected and secured to a drinking vessel lid in which the drinking tube valve means is integrally moulded to a lower distal end of the flexible drinking tube. Since the valve is incorporated into the flexible drinking tube it requires no preassembly, is less likely to suffer damage and is also easier to keep clean.

In another aspect, there is provided a unitary flexible drinking tube and valve construction in which the valve means, which may be a slit-type valve, opens wide enough to allow full liquid flow without the need to apply high levels of suction to the straw and forms a liquid seal that prevents liquid spillage from the cup when no suction is applied to the drinking tube by the user.

In another aspect, there may be provided a cylindrical valve means, which is closed at the distal end of the cylinder. The outer circumference of the cylinder being generally circular and whose inner wall is also circular but eccentric with the outer wall circumference thus creating a thin-walled portion of the cylinder and whose wall thickness gradually increases to the maximum wall thickness diametrically opposite to the thin walled position.

In a preferred aspect, the non-spill drinking tube assembly with integral valve system is made using a flexible material such as silicone or similar suitable food contact approved thermoplastic elastomers, having a typical hardness of shore A 20-60.

BRIEF DESCRIPTION OF THE DRAWINGS

The accompanying drawings illustrate presently exemplary embodiments of the disclosure and together with the general description given above and the description of the embodiments given below serve to explain by way of example only the principles of the disclosure. In the accompanying drawings.

DETAILED DESCRIPTION

Figure 1:
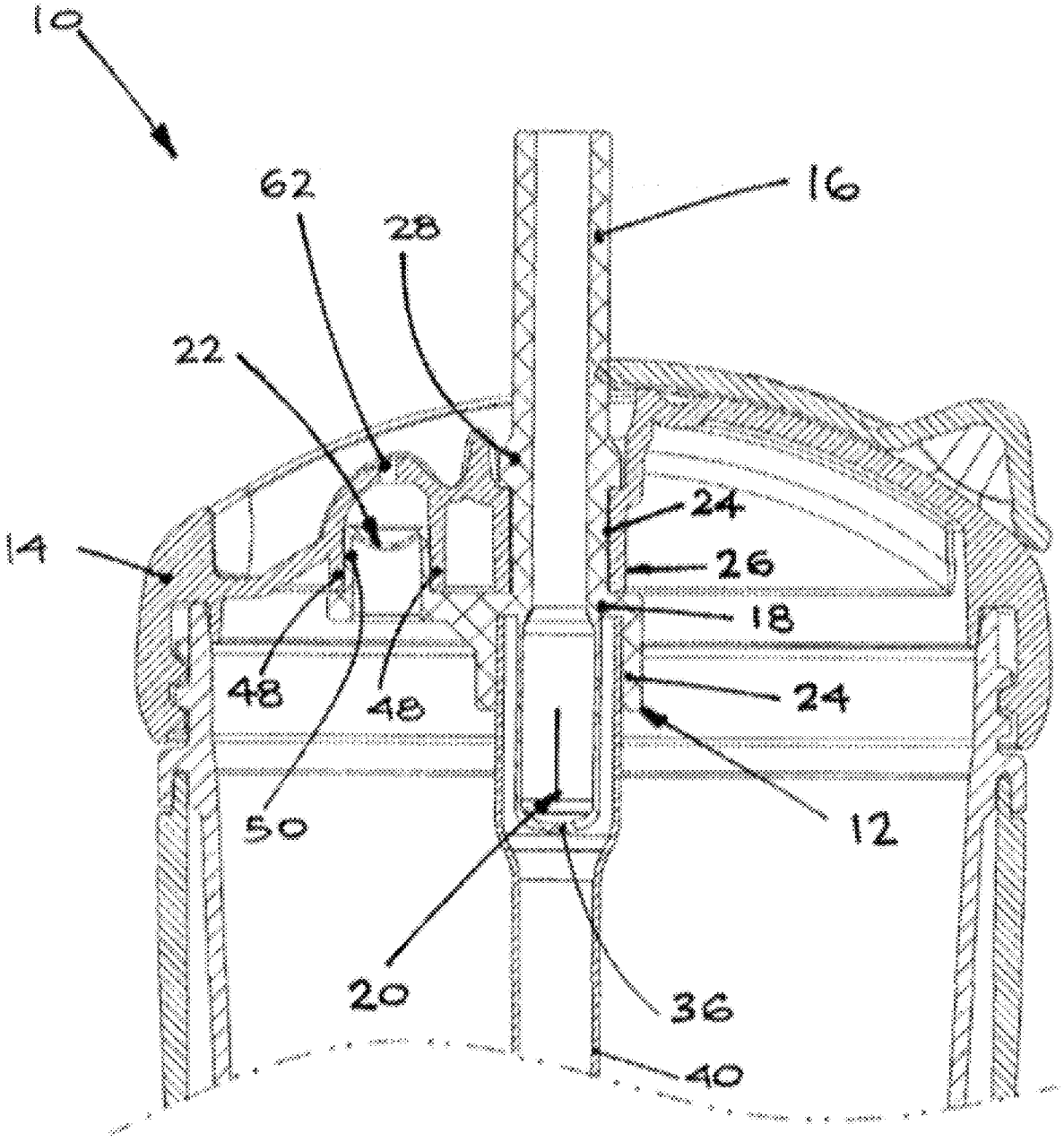
FIG. 1 shows an orthographic sectional side view of a non-spill drinking cup system including a container, a cup base, and a drinking tube, where the drinking tube is in the vertical, drinking position.

Referring now to FIG. 1, a non-spill drinking cup system 10 includes a drinking tube 12 and a lid assembly 14.

The drinking tube 12 includes a generally tubular drinking straw portion 16 protruding from an intervening portion 18. The drinking tube 12 also includes a drinking valve portion 20 and a venting valve 22. In the depicted embodiment, the generally tubular drinking straw portion 16, intervening portion 18, drinking valve portion 20 and venting valve 22 are integrally moulded to form the drinking tube 12. The drinking tube 12 is removably attached to the underside of the lid assembly 14 and is capable of providing full fluid flow through the flexible drinking straw portion 16 even under low suction. The drinking tube 12 is described in more detail with respect to FIGS. 4-14.

Figure 23:
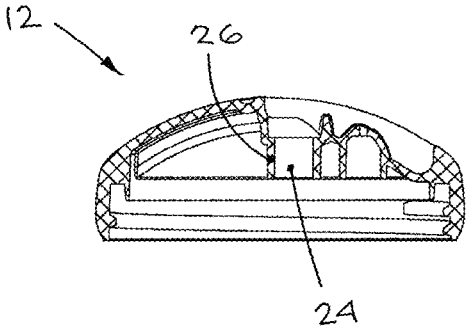
FIG. 23 shows a side orthographic centreline sectional view of the lid assembly of FIG. 21.
Figure 24:
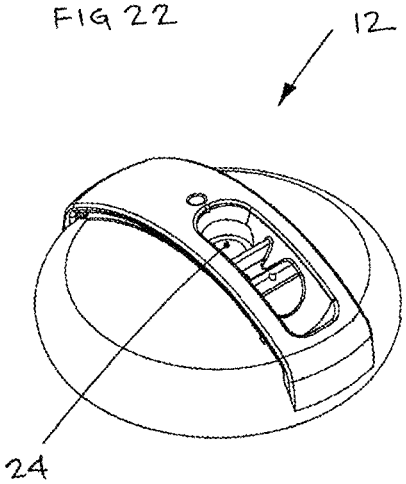
FIG. 24 shows an isometric view of the lid assembly of FIG. 21 when viewed from above.

The lid assembly 14, as shown in FIGS. 1 and 21-24, includes a locating hole or aperture 24 which protrudes from the underside of the lid assembly 14 to define a first locating boss 26 (see FIGS. 1 and 23). In use, the generally tubular flexible drinking straw portion 16 of the drinking tube 12 frictionally engages with the locating hole 24 of the lid assembly 14, and provides a liquid seal therebetween. The intervening portion 18 of the drinking tube 12 engages with, and provides a liquid seal at, the first locating boss 26.

Referring again to FIG. 1, the generally tubular flexible drinking straw portion 16 is secured to the lid assembly 14 by a flange 28, which, when the generally tubular flexible drinking straw portion 16 is pulled through the locating hole 24 in the lid assembly 14, securely clips the generally tubular flexible drinking straw portion 16 into position and prevents the flexible drinking straw portion 16 from being pushed through the locating hole 24 and inside the lid assembly 14. Additionally, a venting hole 62 is provided in the lid assembly 14 to allow air into the system as will become clear from the description of the drinking tube 12 below.

With reference to FIGS. 1 and 4-8, in the depicted embodiment, the flange 28 includes a chamfered upper edge 30 and a squared-off lower edge 32. The chamfered upper edge 30 provides for ease of assembly when pushing the flexible drinking straw portion 16 through the locating hole 24 of the lid assembly 14, whilst the squared-off lower edge 32 prevents the flexible drinking straw portion 16, or indeed the drinking tube 12 as a whole, from being pushed inside the lid assembly 14.

Figure 6:
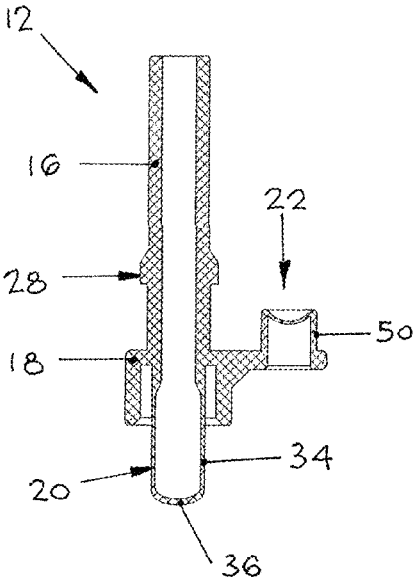
FIG. 6 shows a side orthographic sectional view through the centreline of the drinking tube of FIG. 4.
Figure 7:
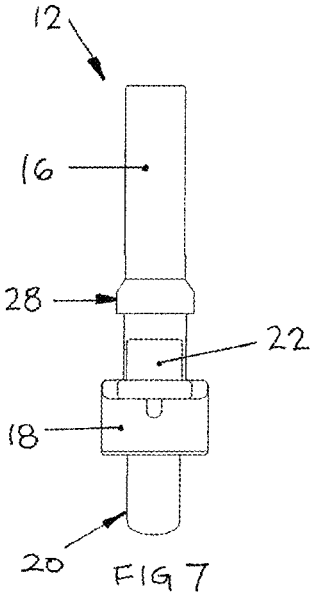
FIG. 7 shows a front orthographic view of the drinking tube of FIG. 4.

At the inner distal end of the drinking tube 12, the drinking valve portion 20, shown in FIGS. 1 and 6, includes a cylindrical wall 34 and a convex end 36. As will be described below, the cylindrical wall 34 is concentric with the intervening portion 18, which is shown as an annular intervening portion, and the thickness of the cylindrical wall 34 varies about its diameter.

Figure 1A:
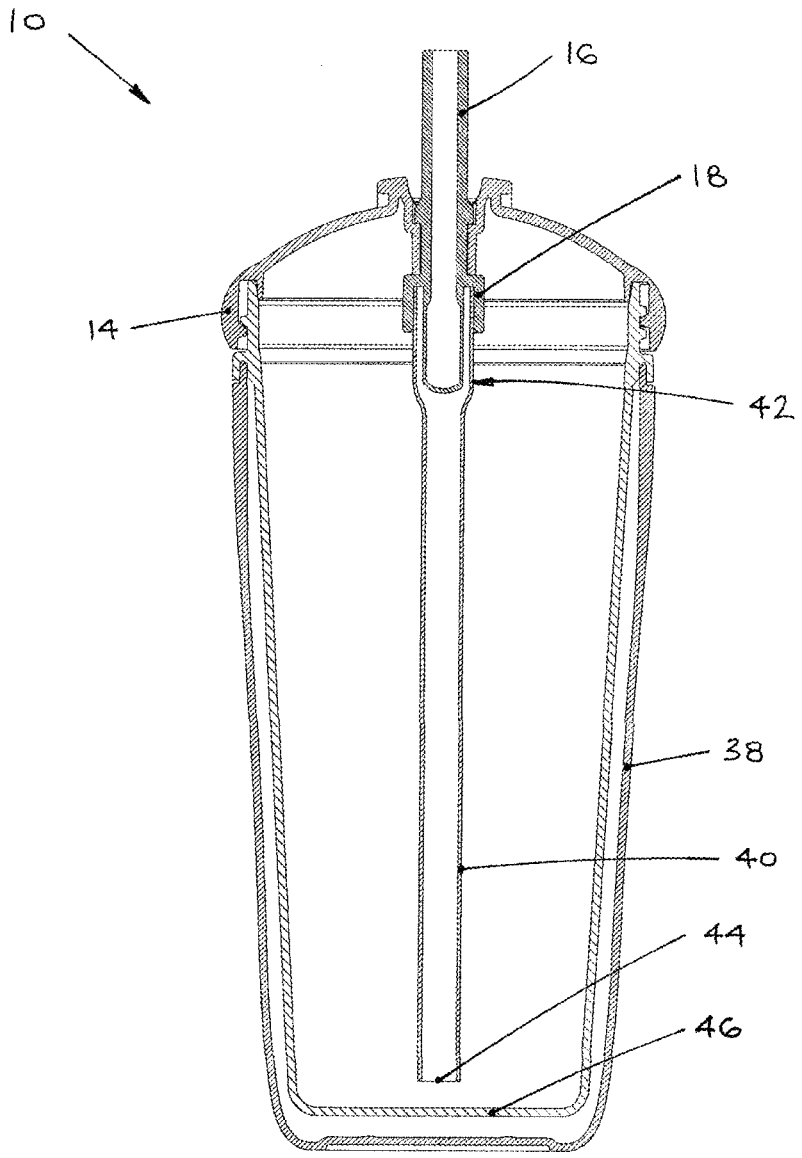
FIG. 1A shows a side orthographic sectional side view of the non-spill drinking cup system of FIG. 1.

Referring now to FIG. 1A, the non-spill drinking cup system 10 is shown with the drinking tube 12 (see FIGS. 1 and 4-9) assembled to the lid assembly 14. The non-spill drinking cup system 10 also includes a cup base 38, which is engageable with the lid assembly 14 by a screw thread.

Figure 2:
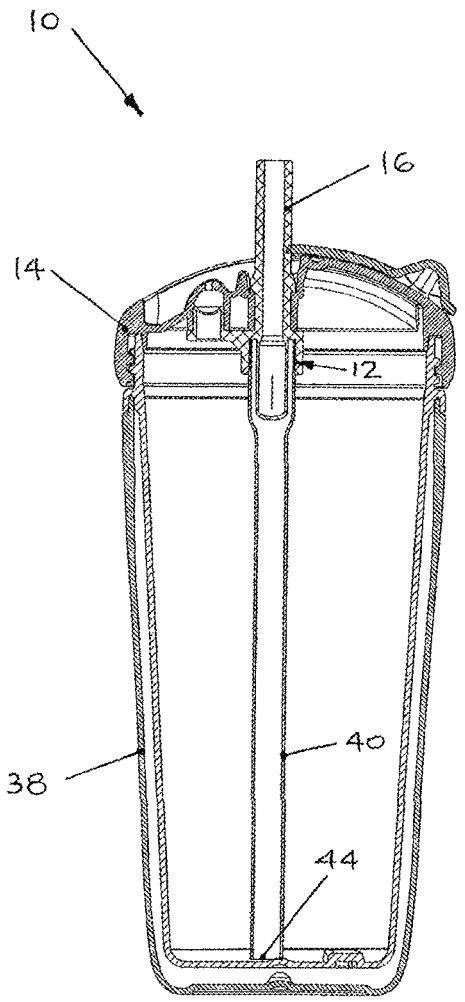
FIG. 2 shows another orthographic sectional view of the non-spill drinking cup system of FIG. 1.
Figure 3:
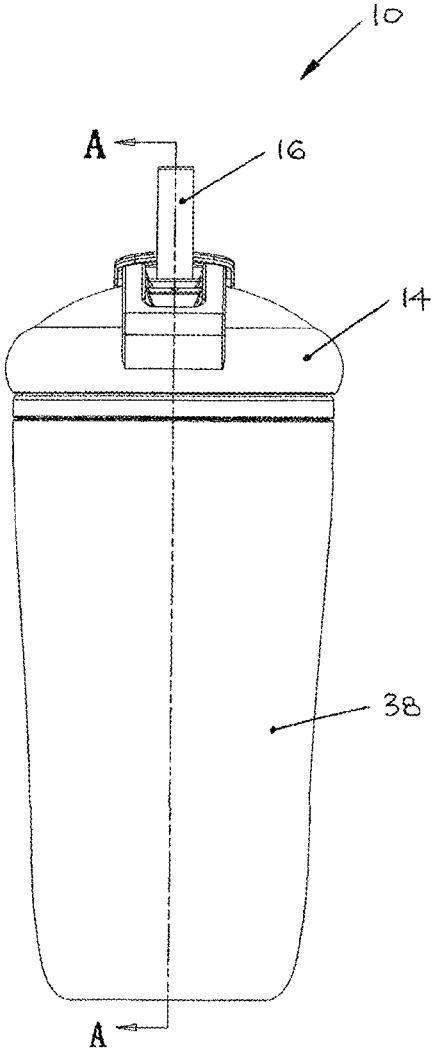
FIG. 3 shows an orthographic view of the non-spill drinking cup system from the front.

The non-spill drinking cup system 10, as shown in FIGS. 1A, 2 and 3, also includes an extension straw 40, which may be semi rigid or flexible and a separate component, which frictionally engages with an annular portion of the intervening portion 18 at an upper end 42 of the extension straw 40. This frictionally engagement provides a liquid seal therebetween. The lower end 44 of the extension straw 40 is positioned close to the floor 46 of the cup base 38 to enable the contents of the cup base to be drunk when the non-spill drinking cup system 10 is held in an upright position. Moreover, the lower end 44 of the extension straw 40 is open to allow fluid flow therethrough.

Figure 4:
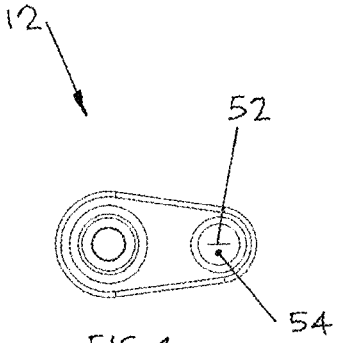
FIG. 4 shows an orthographic view of the drinking tube of FIGS. 1-3 when viewed from above.
Figure 5:
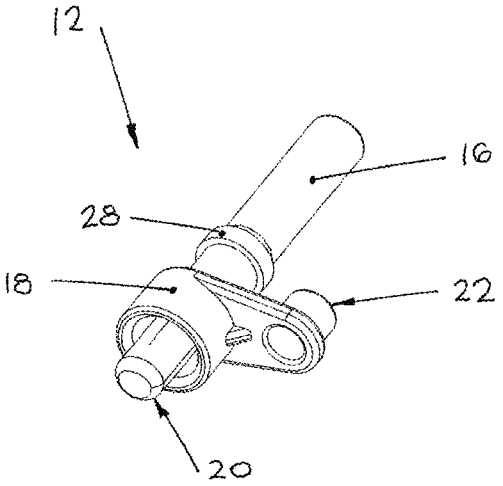
FIG. 5 shows an isometric view of the drinking tube of FIG. 4.

Referring again to FIGS. 1 and 4-9, a vent valve 22 is shown which frictionally engages with a second locating boss 48 of the lid assembly 14 and forms a liquid seal therebetween. The vent valve 22 is shown having a concave surface, which may be thinner than the cylindrical side wall 34 of the vent valve 22. FIG. 4 shows the venting valve 22 in more detail. The venting valve is shown as a slit 52, which is positioned centrally in the concave surface 54, which opens as negative pressure (vacuum) increases when liquid is dispensed from the cup base in use, to allow air flow into the cup base to equalise the air pressure to an atmospheric level, at which point the venting valve slit 52 closes, thereby forming a liquid seal to prevent leakage. This type of venting valve arrangement is often referred to as a 'check valve'.

With reference to FIGS. 12, 13A, 13B, and 13C, the drinking tube 12 is described in more detail. In this depicted embodiment, the drinking tube 12 includes a drinking valve slit 56 as part of the drinking valve portion 20. The drinking valve slit 56 controls the flow of fluid from the cup base (not shown) and through the flexible drinking straw portion 16. The drinking valve portion 20 of the flexible valve member 13 may include a cylindrical wall 34, which, in cross section, is of variable thickness around its circumference.

Figure 13A:
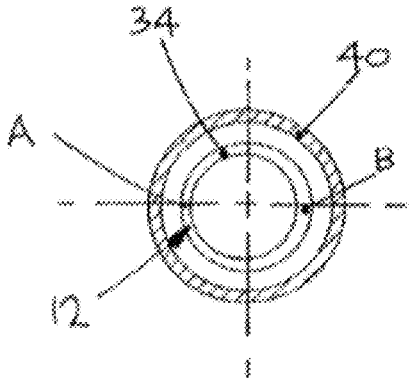
FIG. 13A shows an enlarged orthographic part-sectional view through the drinking tube, with the extension straw assembled, when the drinking valve is in the closed condition.

In the depicted embodiment, and with particular reference to FIG. 13A, the cylindrical wall 34 of the drinking valve portion 20 has a first defined thickness at a first point A and a second defined thickness at a second point B, where point B is diametrically opposite to point A. The second defined thickness at point B is greater than the first defined thickness at point A. The first point A, as can be seen from FIG. 13A, is coincident with the drinking valve slit 56. The first point A is not indicated in FIGS. 13B and 13C for clarity, although it is clear that the first point A is still present and located diametrically opposite to indicated point B, as described in relation to FIG. 13A.

The thickness of the cylindrical wall 34 also gradually decreases from the second point B to the first point A, where the drinking valve slit 56 is located.

Figure 13B:
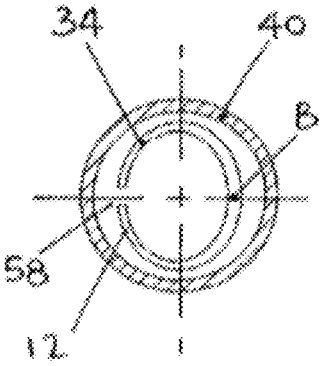
FIG. 13B shows an enlarged orthographic part-sectional view through drinking tube, with the extension straw assembled, when the drinking valve is in the partially open condition when suction is being applied to the generally tubular flexible straw by the user.
Figure 13C:
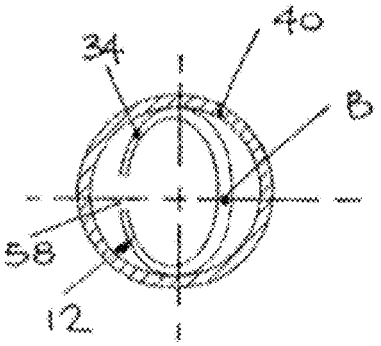
FIG. 13C shows an enlarged orthographic part-sectional view through the drinking tube, with the extension straw assembled, when the drinking valve is in the fully open condition when suction is applied to the generally tubular flexible straw by the user.
Figure 14:
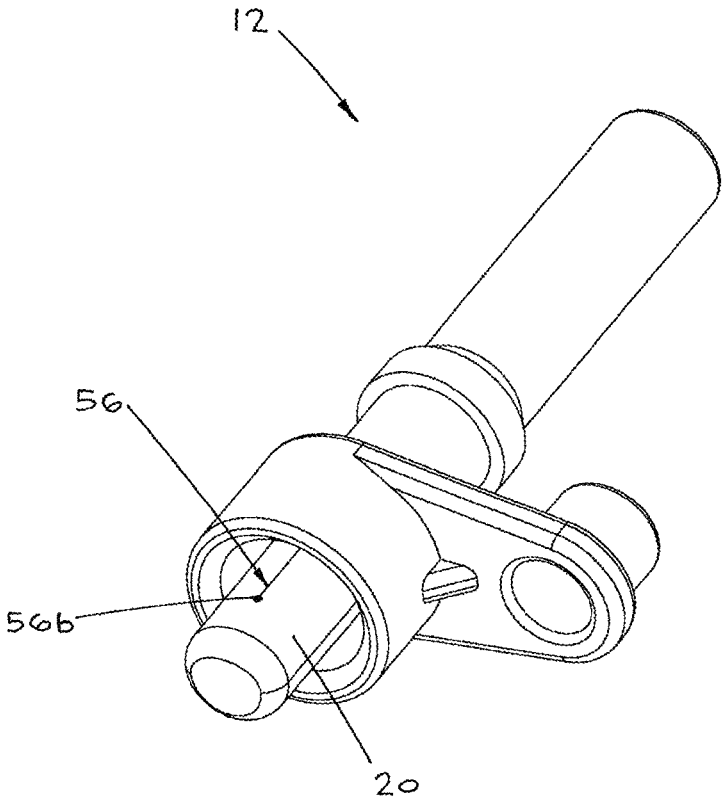
FIG. 14 shows an enlarged isometric view of the drinking tube of FIG. 4.
Figure 15:
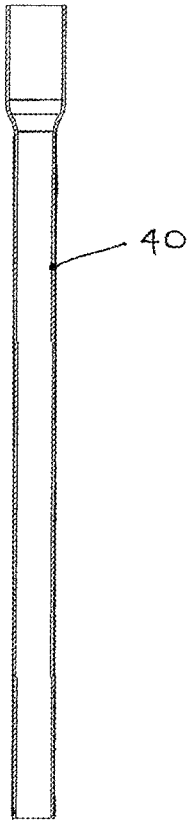
FIG. 15 shows an orthographic centreline sectional view of the extension straw, as shown in FIGS. 1-2.

FIGS. 13A, 13B and 13C show that, upon application of suction to the proximal end of the flexible straw 16, the thinner walled section of the cylindrical wall 34 will gradually collapse in a controlled manner as vacuum increases and, as indicated in the drawings, in doing so will cause the drinking valve slit 56 to open allowing liquid flow into the drinking tube 12 via the created opening 58. The drinking valve slit 56, being between 5-10 mm in length, enables the opening 58 to be large enough to provide full fluid flow through the drinking valve slit 56 even at lower suction levels.

Figure 16:
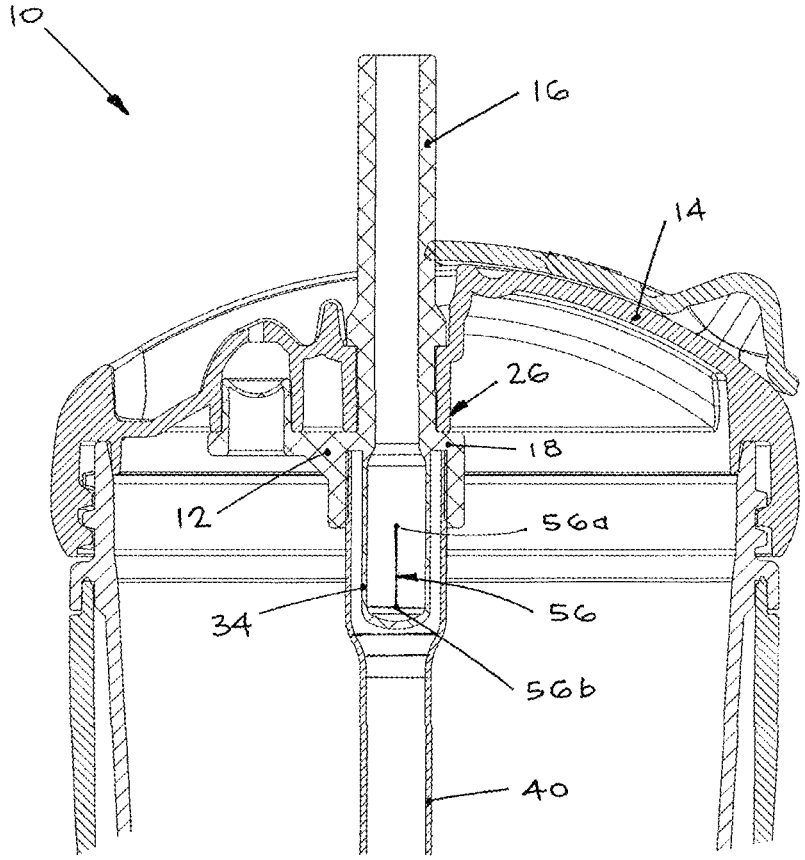
FIG. 16 shows an enlarged side orthographic centreline sectional view through the non-spill drinking cup system, when the drinking valve is in the closed condition.

Referring to FIG. 16, the drinking tube 12 is shown in its natural state when no suction is applied to the drinking straw portion 16 by the user. As can be seen in FIG. 16, the drinking valve slit 56 is closed and in a relaxed condition. The upper 56*a* and lower 56*b* points of the drinking valve slit are indicated.

Figure 17:
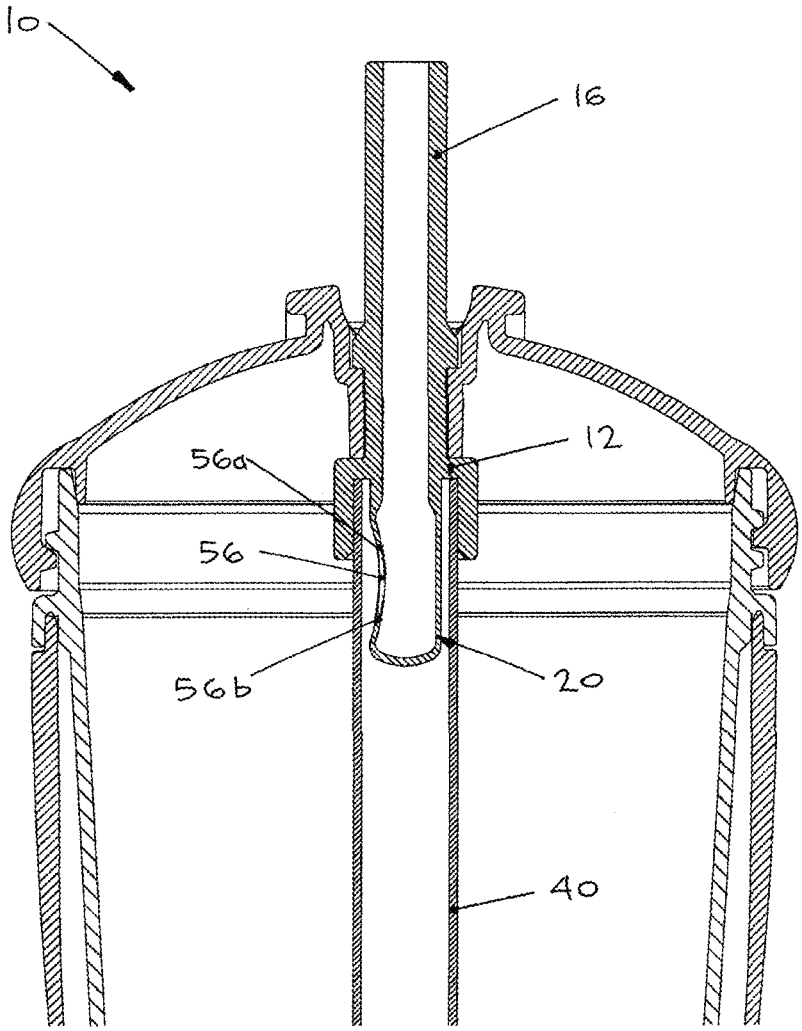
FIG. 17 shows an enlarged front orthographic sectional view through the non-spill drinking cup system, with the drinking valve shown in the open position when suction is applied to the generally tubular flexible straw.

Referring now to FIG. 17, the drinking tube 12 is shown an initially state as suction is commenced at flexible drinking straw portion 16. The thinner walled portion of the cylindrical wall 34 (refer to FIGS. 13A-13C) collapses towards the central axis of the drinking valve portion 20, thereby producing a generally concave portion of the cylindrical wall 34 as seen in FIG. 17.

Figure 18:
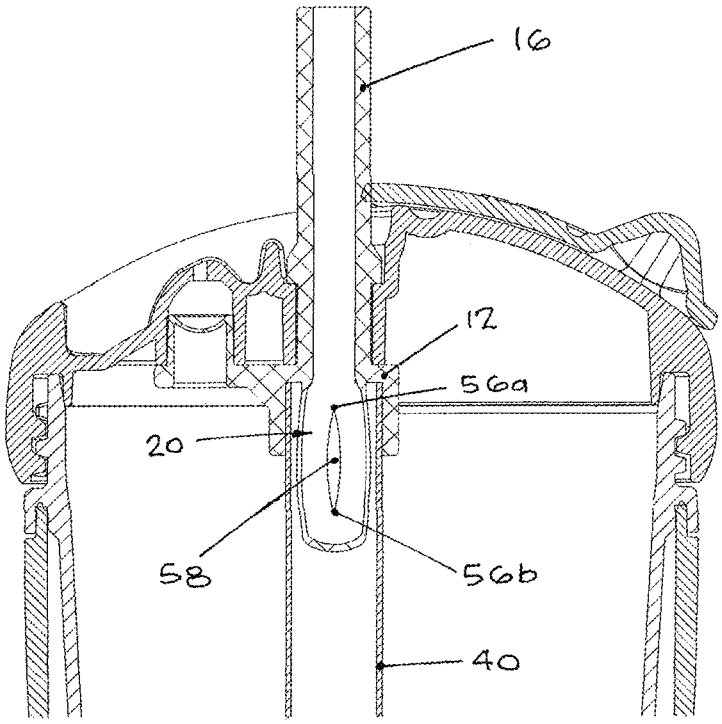
FIG. 18 shows a side orthographic centreline sectional view through the non-spill drinking cup system with the drinking valve in the open condition.
Figure 19:
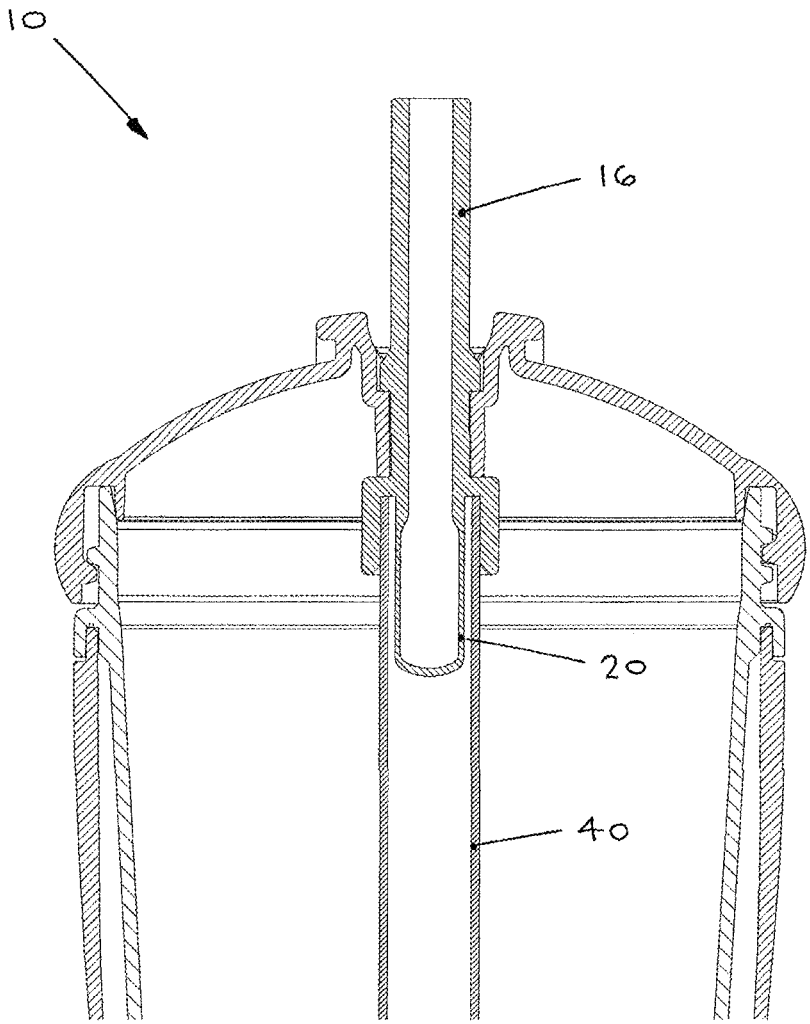
FIG. 19 shows a front orthographic sectional view of the non-spill drinking cup system.
Figure 20:
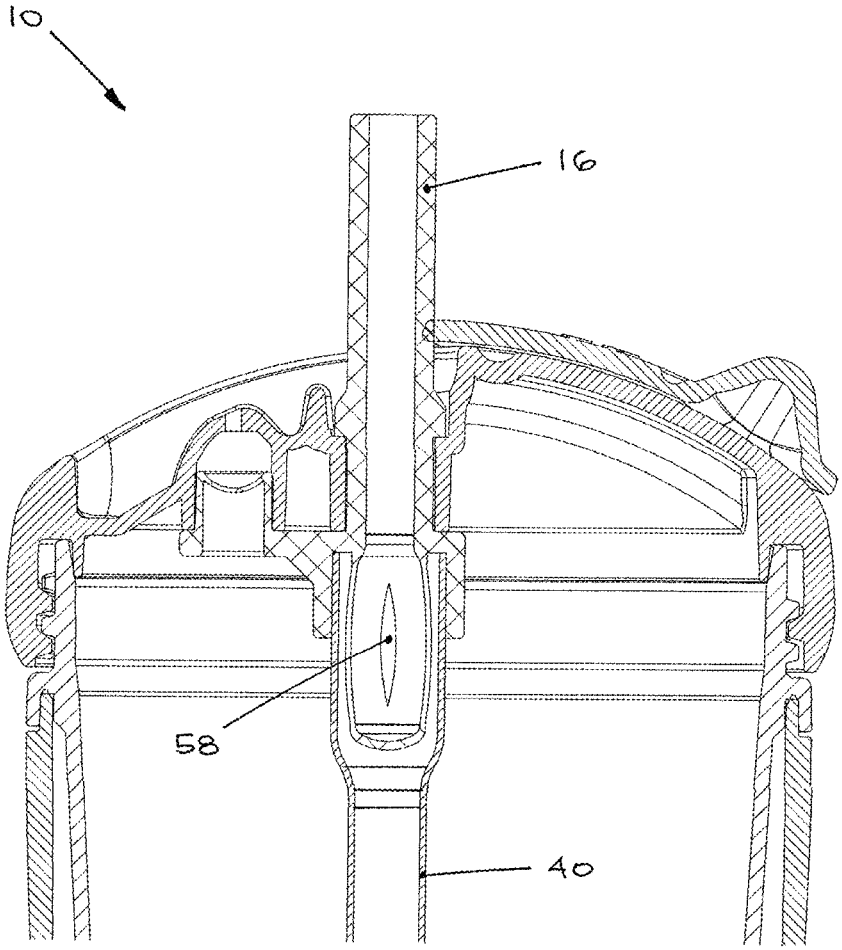
FIG. 20 shows a side orthographic centreline sectional view of the non-spill drinking cup system.
Figure 21:
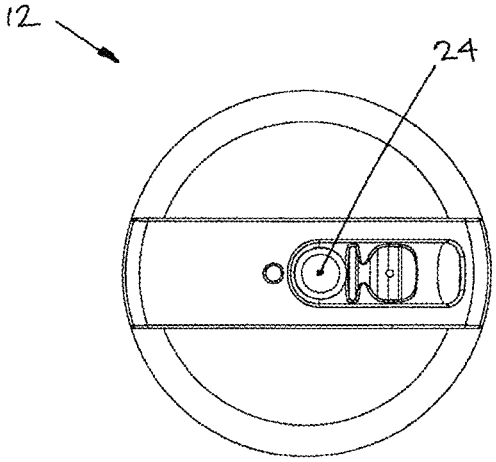
FIG. 21 shows an orthographic view of the lid assembly of the non-spill drinking cup system when viewed from above.
Figure 22:
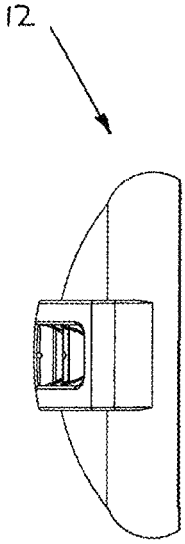
FIG. 22 shows a front orthographic view of the lid assembly of FIG. 21.

With reference to FIG. 18, the drinking valve slit 56 is shown in the open state when suction is applied to the flexible drinking straw portion 16 by the user. As can be seen in FIG. 18, the drinking valve slit 56 is open, thereby creating the opening 58 between upper point 56*a* and lower point 56*b* of the drinking valve slit 56, as referred to in FIGS. 13A-13C.

Positioning the upper end 56*a* of the drinking valve slit 56 is a critical element of the valve design to optimise the way in which the drinking valve slit 56 opens to allow liquid flow. Referring again to FIG. 16, it will be understood that, at the intervening portion 18, which abuts the first locating boss 26 of the lid assembly 14, the flexible drinking straw portion 16 is prevented from collapsing when suction is applied to the flexible drinking straw portion 16 by the user. The drinking valve slit 56 begins in close proximity to the intervening portion 18, at position 56*a*, and ends 5-10 mm lower, at position 56*b*. Since the valve slit 56 at point 56*a* is close to the intervening portion 18, and the valve slit position 56*b* is close to the convex base 36 of the valve, the cylindrical wall 34 will collapse between points 56*a* and 56*b* of the drinking valve slit 56, opening up the opening 58, to allow liquid flow.

It will be understood that if point 56*a* of the drinking valve slit 56 were positioned too far away from the intervening portion 18, the cylindrical wall 34 may simply collapse and leave the drinking valve slit 56 in a closed condition, in which case there would be no liquid flow.

Figure 25:
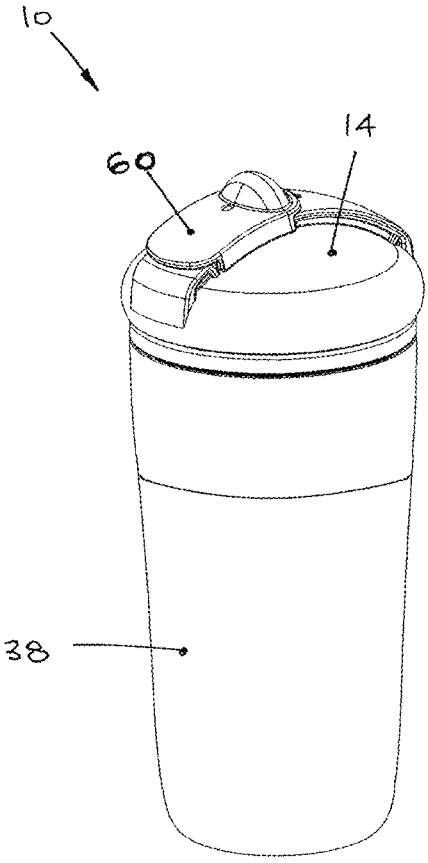
FIG. 25 shows an isometric view of the non-spill drinking cup system with a sliding cover of the lid assembly in the closed position.
Figure 26:
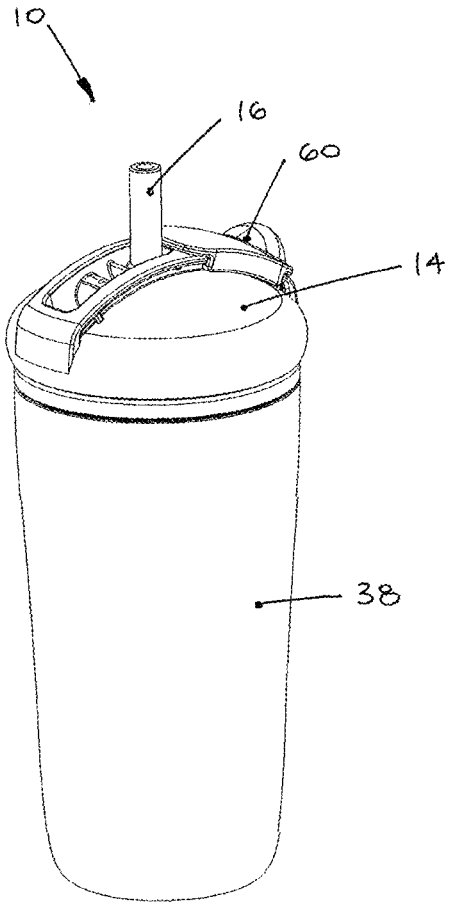
FIG. 26 shows an isometric view of the non-spill drinking cup system with the sliding cover of the lid assembly in the open position.
Figure 27:
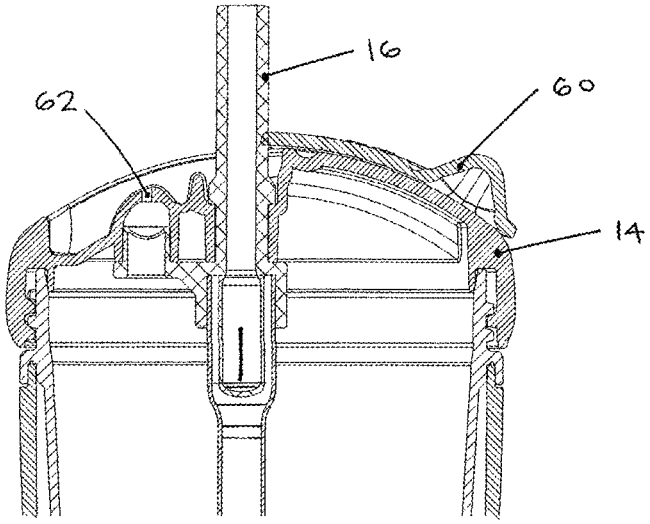
FIG. 27 shows a side orthographic centreline sectional view of the non-spill drinking cup system with the sliding cover of the lid assembly in the open position.
Figure 28:
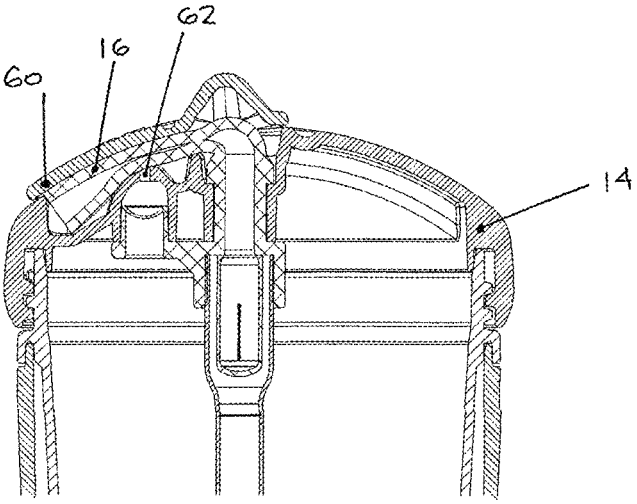
FIG. 28 shows a side orthographic centreline sectional view of the non-spill drinking cup system with the sliding cover of the lid assembly in the closed position.

With reference now to FIGS. 25, 26, 27 and 28, a sliding cover 60 is clipped to the outside of the lid assembly 14, which is shown in the open, drinking position in FIGS. 26 and 27. When the sliding cover 60 is actuated, by sliding the cover to the closed position as shown in FIGS. 25 and 28, this sliding action flexes the flexible drinking straw portion 16 from the open drinking position to a closed position. It will be seen that, with the sliding cover 60 in the closed position, the vent hole 62, in the lid assembly 14, is sealed by the flexible drinking straw portion 16, as it is compressed between the underside of the sliding cover 60, and the vent hole 62. It can also be seen that, in the closed position, the flexible drinking straw portion 16 occupies a slot in the lid assembly 14.

Figure 29:
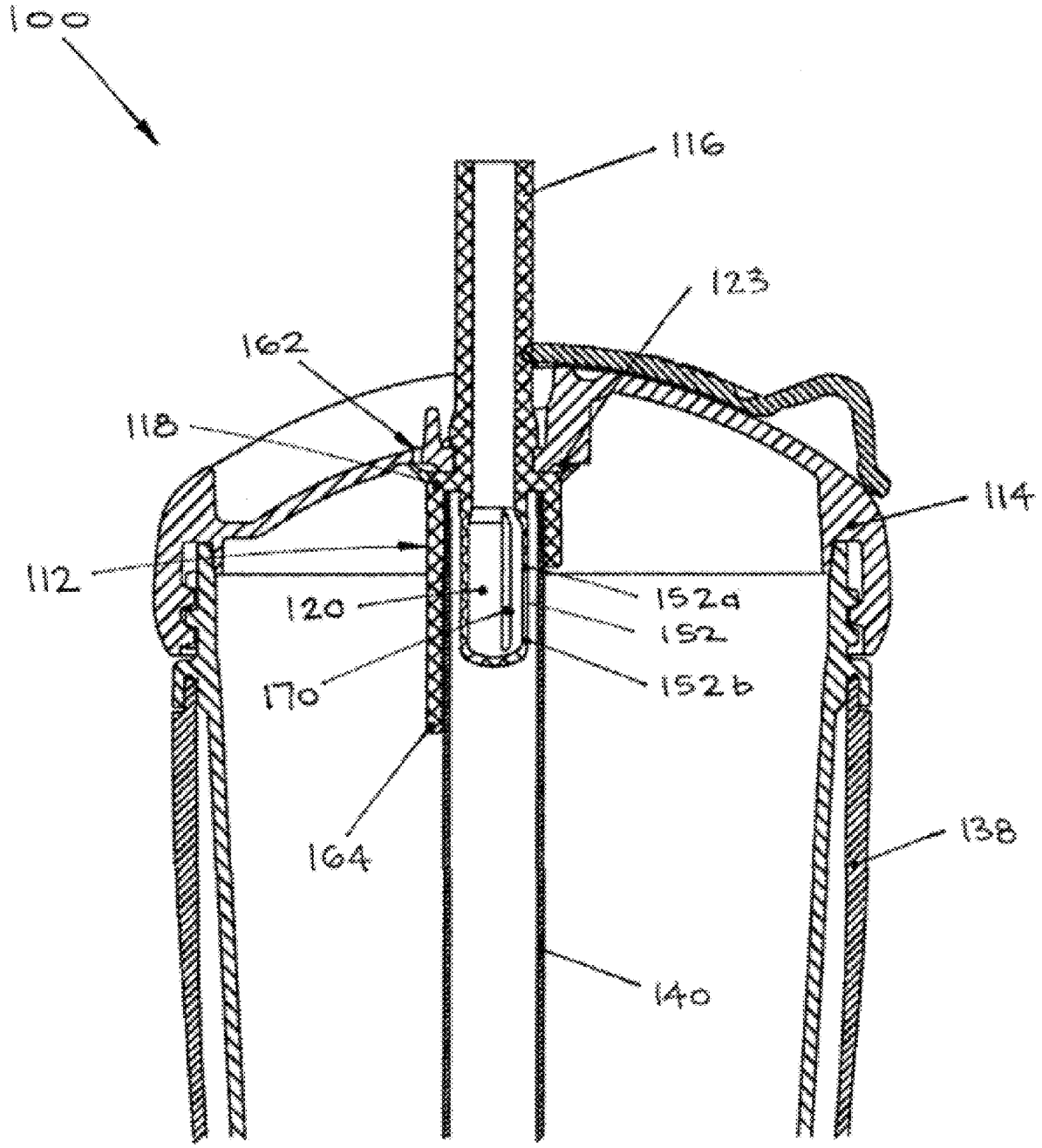
FIG. 29 shows a side orthographic centreline sectional view of the non-spill drinking cup assembly, including a second embodiment of the drinking tube, with the sliding cover of the lid assembly in the open position.

Referring now to FIG. 29, there is described an alternative drinking cup system 100 including an alternative drinking tube 112. The depicted non-spill drinking cup valve system includes a drinking tube 112 removably attached to the underside of a lid assembly 114. The lid assembly 114 of this alternative embodiment is substantially similar in construction to that described in the former embodiment. Additionally, the drinking cup system 100 includes a cup base 138, with is screwed to lid assembly 114. An extension straw 140 is also shown and is substantially as described in the former embodiment.

Figure 30:
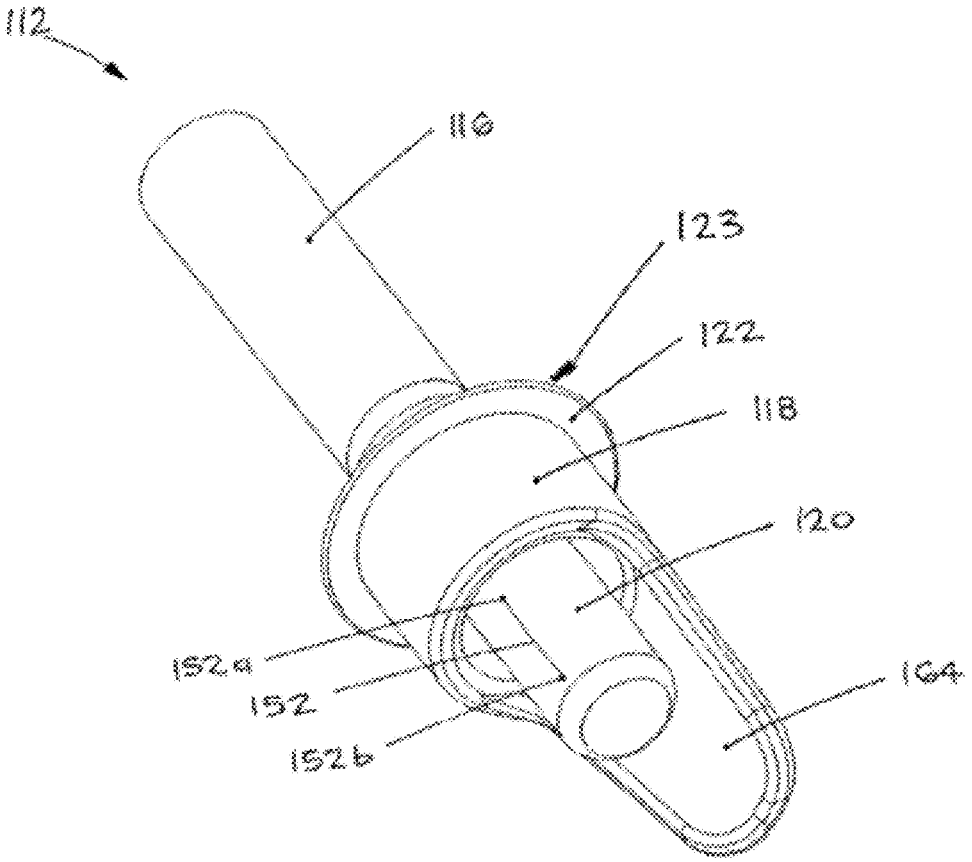
FIG. 30 shows an isometric view of the drinking tube of FIG. 29 when viewed from below.

With further reference to FIGS. 29 and 30, the drinking tube 112 includes a generally tubular flexible drinking straw portion 116 protruding from an intervening portion 118. The flexible valve member also includes a drinking valve portion 120. In the depicted embodiment, the drinking tube 112, including the flexible drinking straw portion 116, the intervening portion 118 and the drinking valve portion 120, are integrally formed. The drinking tube 112 is removably attached to the lid assembly 114 and capable of providing full fluid flow through the flexible drinking straw portion 116 even under low suction.

The drinking valve portion 120 is shown as including a drinking valve slit 152 that operates in a manner substantially the same as the described former embodiment.

Still referring to FIGS. 29 and 30, the drinking tube 112 includes a venting valve 123. The venting valve 123 may be substantially similar to that described in the former embodiment. However, in the depicted embodiment, another venting valve is described. The venting valve 123 incorporates a thin walled lip 122, which maintains a compressive seal when the tip of the thin walled lip 122 is in contact with the underside of the lid assembly 114. As negative pressure builds up inside the drinking vessel when suction is applied to the flexible drinking straw portion 116 by the user, air enters through a vent hole 162 in the lid assembly 114. When a pre-determined level of suction is achieved within the drinking cup system 100 the described vent valve 123 flexes in a downward direction, that is, in a direction towards the floor or base of the cup base 138, to allow air-flow into the cup base 138 to equalise the internal pressure to atmosphere.

FIGS. 29 and 30 also show that the drinking valve portion 120 provides a drinking valve slit 154 between points 152*a* and 152*b*.

Figure 32:
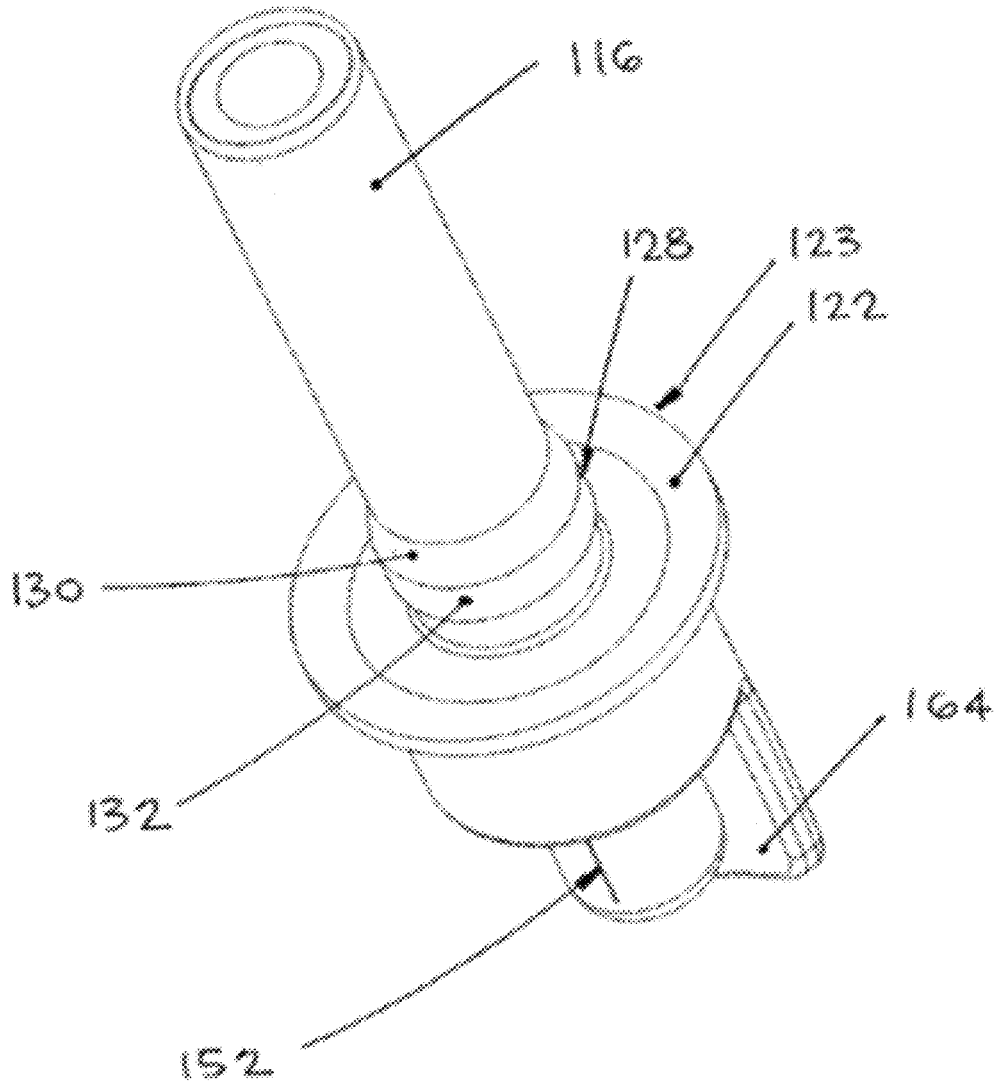
FIG. 32 shows an isometric view of the drinking tube of FIG. 29 when viewed from above.

Additionally, as shown in FIGS. 29, 30 and 32, the drinking tube 112 is provided with an optional removal tab 164, which enables easy disassembly for cleaning.

Figure 31A:
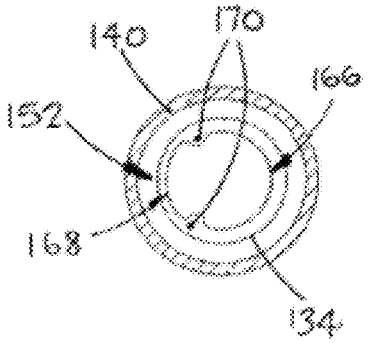
FIG. 31A shows an enlarged orthographic part-sectional view through the drinking tube of FIG. 30, with the extension straw assembled, when the drinking valve is in the closed condition.

While FIG. 13A shows a cross section through the drinking tube 12 showing that the cylindrical wall 34 has a gradual varying thickness, in this embodiment, FIG. 31A shows two distinct wall thicknesses wherein a first portion 166 of the cylindrical wall 134 is thicker, while a second portion 168 of the cylindrical wall 134 is thinner. Of course, as the person skilled in the art would appreciate, the construction shown in FIG. 13A could equally apply to this embodiment, and thus may include a gradual change in the thickness of the cylindrical wall 134 as described above.

Between the first portion 166 and the second portion 168 there is positioned two longitudinal strengthening ribs 170, also shown in FIG. 29. The drinking valve slit 152 is positioned centrally in the first portion 166. In other words, the drinking valve slit 152 is position equidistant from each longitudinal rib 170.

Referring now to FIG. 31A, a cross sectional view is shown through the cylindrical wall 134 of the drinking valve portion 120. In this embodiment the thicker first portion 166, together with the strengthening ribs 170, help to maintain the circular cross sectional shape of the cylindrical wall 134, under suction. This thickened first portion 166 ensures that the collapse of the drinking valve portion 120 is concentrated within the thinner second portion 168. The internal ribs 170 shown in this embodiment also ensure that, in the event of the drinking valve portion 120 collapsing completely and potentially closing off the liquid flow, the ribs 170 prevent complete valve closure, thus ensuring that a liquid flow path is always maintained even under high levels of suction.

Figure 31B:
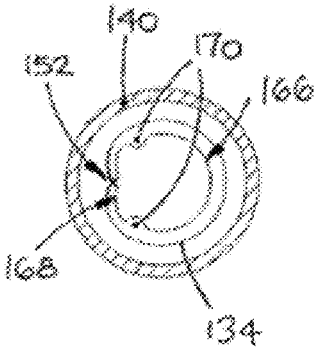
FIG. 31B shows an enlarged orthographic part-sectional view through the drinking tube, with the extension straw assembled, when the drinking valve is in the partially open condition when suction is applied to the generally tubular flexible straw by the user.
Figure 31C:
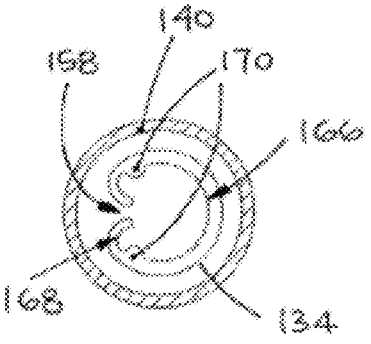
FIG. 31C shows an enlarged orthographic part-sectional view through the drinking tube, with the extension straw assembled, when the drinking valve is in the fully open condition when suction is applied to the generally tubular flexible straw by the user.

Referring to FIG. 31B, as suction is applied the drinking valve portion 120 begins to collapse inwardly towards the central axis of the drinking valve portion 120. More specifically, the cylindrical wall 134 adjacent to the drinking valve slit 152 begin to collapse inwards. As shown in FIG. 31C, once the slit 152 has opened, or otherwise collapsed inwardly about the ribs 170, a gap 158 is provided thus allowing fluid flow from the cup base (not shown), through the extension straw 140, through the flexible valve member 112 as a whole, and into the user's mouth.

Figure 8:
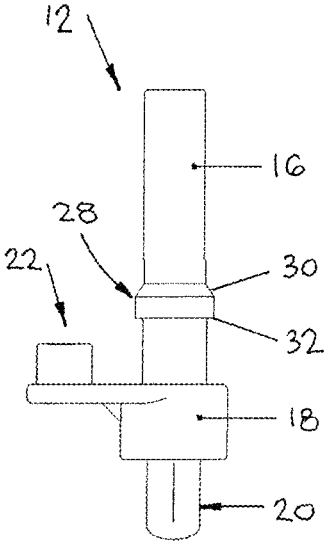
FIG. 8 shows a side orthographic view of the drinking tube of FIG. 4.
Figure 9:
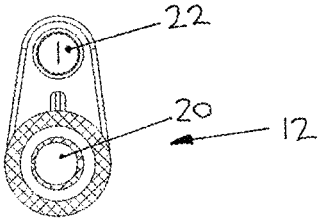
FIG. 9 shows an orthographic sectional view through the drinking tube of FIG. 4 when viewed from below.
Figure 10:
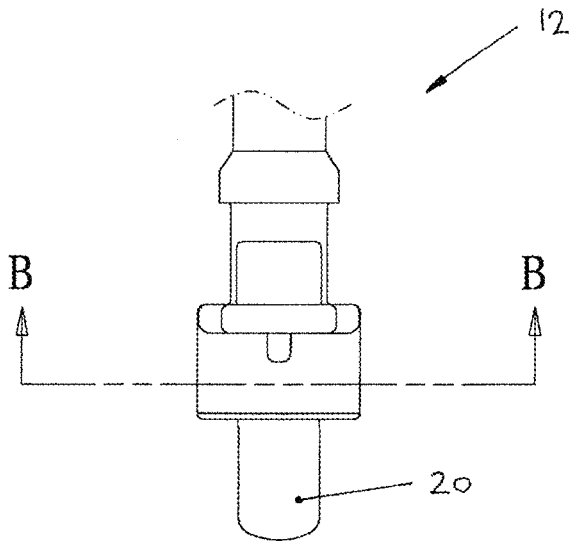
FIG. 10 shows an orthographic view of the drinking tube of FIG. 4 when viewed from the front, and indicating section B-B.
Figure 11:
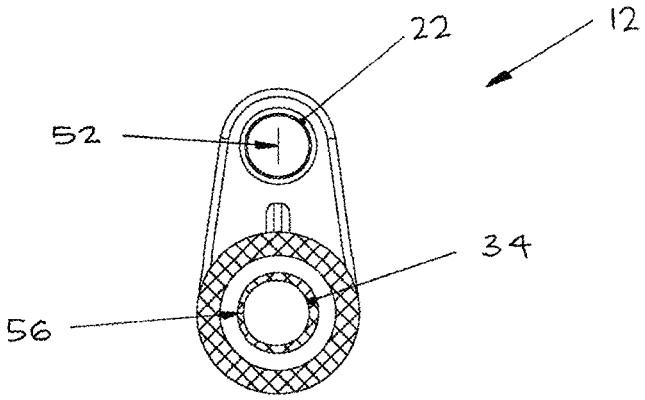
FIG. 11 shows an orthographic sectional view of the drinking tube of FIG. 10 with section B-B through the valve.
Figure 12:
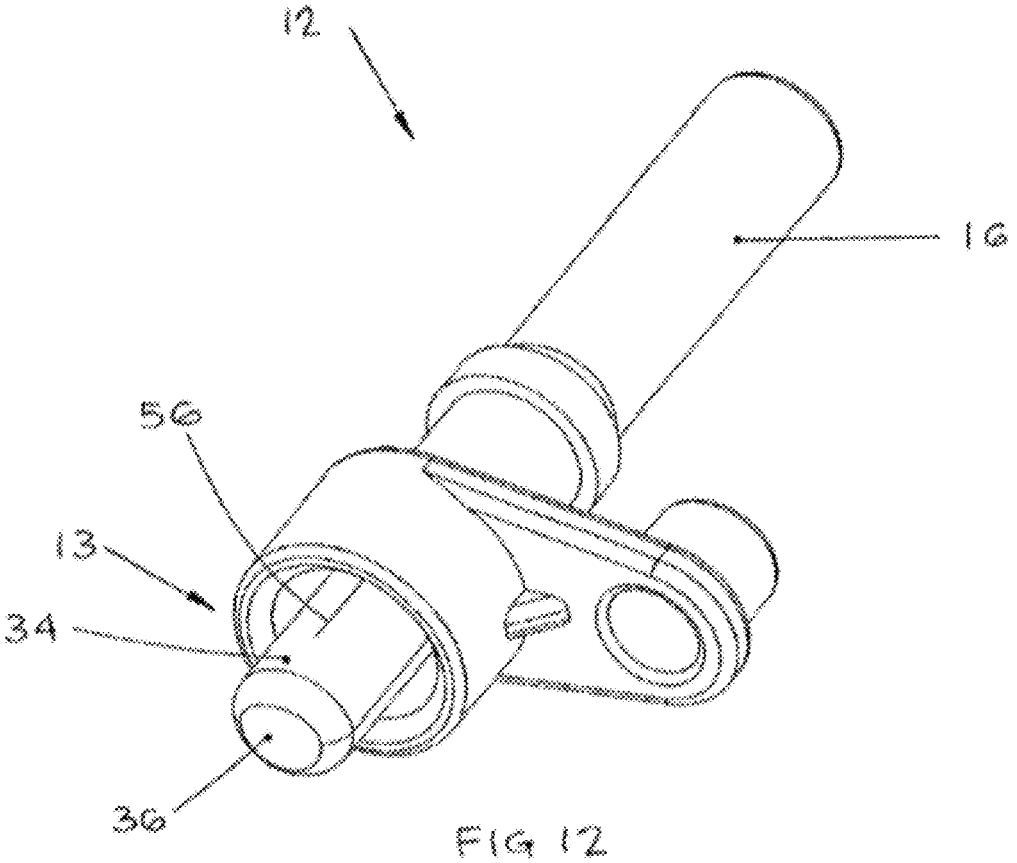
FIG. 12 shows another isometric view of the drinking tube of FIG. 4.

Finally, as described in relation to FIG. 8, the depicted embodiment in FIG. 32 includes a flange 128. The flange includes an upper chamfered edge 130 and a lower squared-off edge 132. As in the previous embodiment, this flange 128 prevents the user from pushing the flexible drinking straw portion 116 back inside of the lid assembly 114 (not shown).

It will be appreciated by persons skilled in the art that the above embodiments have been described by way of example only and not in any limiting sense, and that carious alterations and modifications are possible without departing from the scope of the invention as defined in the appended claims.

What is claimed is:

1. A non-spill drinking cup system comprising:

a container;

a lid assembly that is removably attachable to the container, comprising an aperture; and a drinking tube, wherein the drinking tube extends through the aperture, the drinking tube comprising:

an open end, a closed end, and a side wall; and a drinking valve, wherein the drinking valve includes:

a drinking valve slit disposed within the side wall, wherein the drinking valve slit comprises at least one elongated slit, and wherein the drinking valve slit controls the flow of fluid by opening and closing the at least one elongated slit;

wherein an interior of the side wall is provided with at least a pair of strengthening ribs, each strengthening rib being disposed substantially near to, and at each side of, the or each elongated slit;

wherein the strengthening ribs separate the side wall into a first side and a second side, wherein the first side has a thickness that is greater than the second side, and wherein the or each elongated slit is included within the second side.

2. The non-spill drinking cup system according to claim 1, wherein the drinking tube further comprises:

a drinking straw portion at the open end of the drinking tube;

a drinking valve portion, including the drinking valve, at the closed end of the drinking tube; and an intervening portion between the drinking straw portion and the drinking valve portion.

3. The non-spill drinking cup system according to claim 2, wherein the intervening portion is annular, and wherein the annular intervening portion is concentric with the drinking valve portion.

4. The non-spill drinking cup system according to claim 2, wherein a thickness of a wall of the intervening portion is greater than a thickness of a wall of the drinking valve portion.

5. The non-spill drinking cup system according to claim 2, further comprising an extension straw that frictionally engages with the intervening portion such that the drinking valve portion extends into a through bore of the extension straw.

6. The non-spill drinking cup system according to claim 2, wherein the drinking straw portion comprises a flange, wherein the flange includes a chamfered upper edge and a squared-off lower edge.

7. The non-spill drinking cup system according to claim 2, wherein the intervening portion includes a removal tab.

8. The non-spill drinking cup system according to claim 2, wherein the intervening portion is adapted to secure the drinking tube to the lid assembly.

9. The non-spill drinking cup system according to claim 1, wherein the closed end is convex.

10. The non-spill drinking cup system according to claim 1, wherein the or each elongated slit is 5-10 mm in length.

11. The non-spill drinking cup system according to claim 1, wherein a thickness of the side wall varies from one side to another side.

12. The non-spill drinking cup system according to claim 1, wherein the side wall has a first thickness at a first point in which the or each elongated slit is located, and a second thickness at a second point, the second point being on an opposite side of the first point, wherein the second thickness at the second point is greater than the first thickness at the first point.

13. The non-spill drinking cup system according to claim 12, wherein a thickness of the side wall increases gradually from the first point to the second point.

14. The non-spill drinking cup system according to claim 1, wherein the drinking tube further comprises a venting valve.

15. The non-spill drinking cup valve system according to claim 14, wherein the venting valve includes a lip which engages with the lid assembly to provide a liquid seal to prevent fluid flowing through a venting hole.

16. The non-spill drinking cup valve system according to claim 1, wherein the lid assembly comprises a drinking straw locating boss having the aperture therein.

17. The non-spill drinking cup valve system according to claim 1, wherein the lid assembly includes a circumferential shoulder that is configured to frictionally engage with a squared lower edge of a flange of the drinking tube.

18. The non-spill drinking cup system according to claim 1, wherein the drinking tube comprises silicone or a thermoplastic elastomer.

19. The non-spill drinking cup system according to claim 1, wherein the drinking tube has a Shore A hardness of 20-60.

20. The non-spill drinking cup valve system according to claim 1, wherein the lid assembly includes a sliding cover, and wherein the drinking tube is adjustable from a drinking position, where the drinking tube protrudes from the aperture of the lid assembly, to a closed position, where the drinking tube is held within a slot of the lid assembly by the sliding cover.

21. The non-spill drinking cup system according to claim 1, wherein the lid assembly and the container are secured by a screw thread, a push-fit or a clip-fit.

22. The drinking tube of claim 1 for inserting through a lid assembly of a non-spill drinking cup system.

23. The non-spill drinking cup system according to claim 1, wherein the at least one elongated slit comprises a plurality of elongated slits.

* * * * *